US005398473A

United States Patent [19]

Chan

[11] Patent Number: 5,398,473

[45] Date of Patent: Mar. 21, 1995

[54] BUILDING CLADDING SYSTEM

[76] Inventor: Stephen Chan, 3573 Napier Street, Vancouver, B.C., Canada, V5K 2X8

[21] Appl. No.: 114,919

[22] Filed: Sep. 2, 1993

[51] Int. Cl.[6] ..... E04B 1/38

[52] U.S. Cl. ..... 52/506.06; 52/235; 52/243; 52/506.01; 52/506.05

[58] Field of Search ..... 52/235, 506.01, 506.05, 52/506.06, 506.08, 506.09, 510, 243, 520, 597, 550

[56] References Cited

U.S. PATENT DOCUMENTS

| | | | |
|---|---|---|---|
| 3,621,635 | 3/1970 | De Lange | 52/506.05 X |
| 3,628,297 | 12/1971 | Richardson | 52/506.05 X |
| 3,834,099 | 9/1974 | Haeussler | 52/506.05 X |
| 4,553,366 | 11/1985 | Guerin | 52/506.08 |
| 4,890,433 | 1/1990 | Funaki | 52/510 X |
| 4,891,924 | 1/1990 | Rose | 52/543 X |
| 4,928,467 | 5/1990 | Hinetsa | 52/510 X |
| 4,987,712 | 1/1991 | Mancuso | 52/506.08 X |
| 5,191,745 | 3/1993 | Story | 52/506.05 |
| 5,220,758 | 6/1993 | Stommel | 52/235 |

*Primary Examiner*—Carl D. Friedman
*Assistant Examiner*—Beth A. Aubrey
*Attorney, Agent, or Firm*—Brian M. Long

[57] ABSTRACT

A building cladding system employs fasteners for securing cladding panels, each having a front face, a near face and a peripheral edge, to support rails mounted horizontally on a wall of a building. The cladding panels have metal support members extending rearwardly from the rear faces of said cladding panels and the support members and the support rails have portions which interengage for suspending the cladding panels from the support rail. The cladding panels also have metal projections extending from the rear faces and including securement portions located beyond the peripheral edges of the respective cladding panels and further fasteners engageable engaging the securement portions for securing the metal projections to the building wall.

6 Claims, 4 Drawing Sheets

BUILDING CLADDING SYSTEM

BACKGROUND OF THE INVENTION

1. Field of the Invention

The present invention relates to building cladding systems and is useful, in particular, but not exclusively for the cladding of building walls which include vertical wooden or metal studs.

2. Description of the Related Art

In conventional building construction, the exterior walls of buildings are usually clad by a layer of stucco or siding provided on a panel, e.g. of plywood or chipboard, which is secured to wall studs.

Stucco has the disadvantages that it is time consuming to apply and that the quality of the stucco depends on the care and skill with which it is applied.

Siding also is relatively time consuming to apply and does not provide the solidity and appearance of masonry.

BRIEF SUMMARY OF THE INVENTION

It is accordingly an object of the present invention to provide a cladding system which enables precast concrete cladding panels to be readily applied to a building.

According to the present invention, a building cladding system comprises a plurality of cladding panels each having a front face, a rear face and a peripheral edge, and a plurality of metal support rails, with rail fasteners for securing the support rails horizontally on a wall of a building. The cladding panels have metal support members extending rearwardly from the rear faces, and the support members and the support rails have portions which are interengageable for suspending the cladding panels from the support rails.

The cladding panels further comprise metal projections extending from the rear faces and including securement portions located beyond the peripheral edges of the respective ones of the cladding panels, with further fasteners engageable with the securement portions for securing the metal projections to the building wall.

When this building cladding system is in use, the support rails are firstly fastened to the building wall, for example by attachment to the exterior building wall.

The cladding panels can then be supported from the metal rails and, while each cladding panel is thus supported, the further fasteners can be engaged with the securement portions of the metal projections before the installation of an adjacent cladding panel in front of the securement portions.

Since the securement portions extend beyond the peripheral edges of the cladding panels they are accessible, for the in section of the further fasteners, until they are covered by the subsequent installation of adjacent panels.

In the preferred embodiment of the invention, the interengageable portions of the support rails form upwardly open recesses, and the interengageable portions of the support members extend downwardly and are spaced from the rear faces so as to be engageable in the upwardly open recesses. Consequently, the cladding panels can be easily and gently dropped into engagement with the support rails to support the cladding panels from the support rails.

The interengageable portions of the support rails and the support members, in the preferred embodiment, are formed of metal channel sections, the recesses of the support rails being upwardly divergent and the interengageable portions of the support members diverging downwardly from the rear faces of the cladding panels to facilitate such relative movement of the support rails and the support members into mutual interengagement.

Since the wall studs can be reinforced by the securing of the support rails to the studs, it is possible to omit the plywood or other sheathing normally used for that purpose.

Also, the cladding panels may be precast in a factory or other building providing a controlled environment, so that the manufacturer of the panels is not affected by the weather.

The panels may be designed to provide more solidity and better heat insulation than conventional siding materials.

BRIEF DESCRIPTION OF THE DRAWINGS

Further features, advantages and objects of the present invention will be more readily apparent from the following description thereof when taken in conjunction with the accompanying drawings, in which.

THE PREFERRED EMBODIMENT

Figure 1:
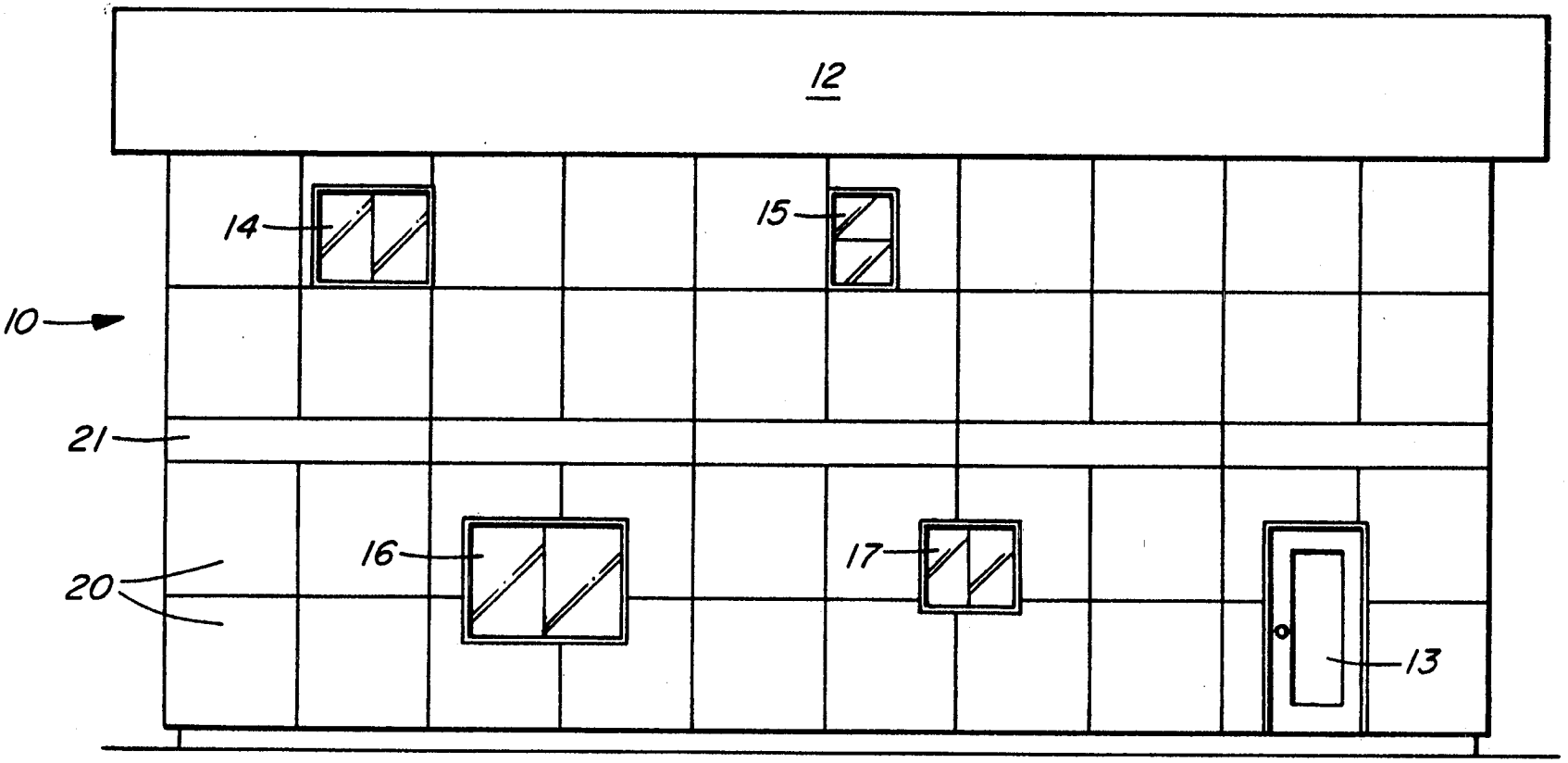
FIG. 1 shows a diagrammatic view, in front elevation, of a building cladding system according to the present invention installed on a front wall of a building.

FIG. 1 shows, in front elevation, a building indicated generally by reference numeral 10 and having a roof 12, a door 13 and windows 14 through 17. The front of the building is also clad with a plurality of square cladding panels 20, which are cut-away where necessary to fit around the door 13 and the windows 14 through 17, and a row of horizontally elongate rectangular cladding panels 21.

Figure 2:
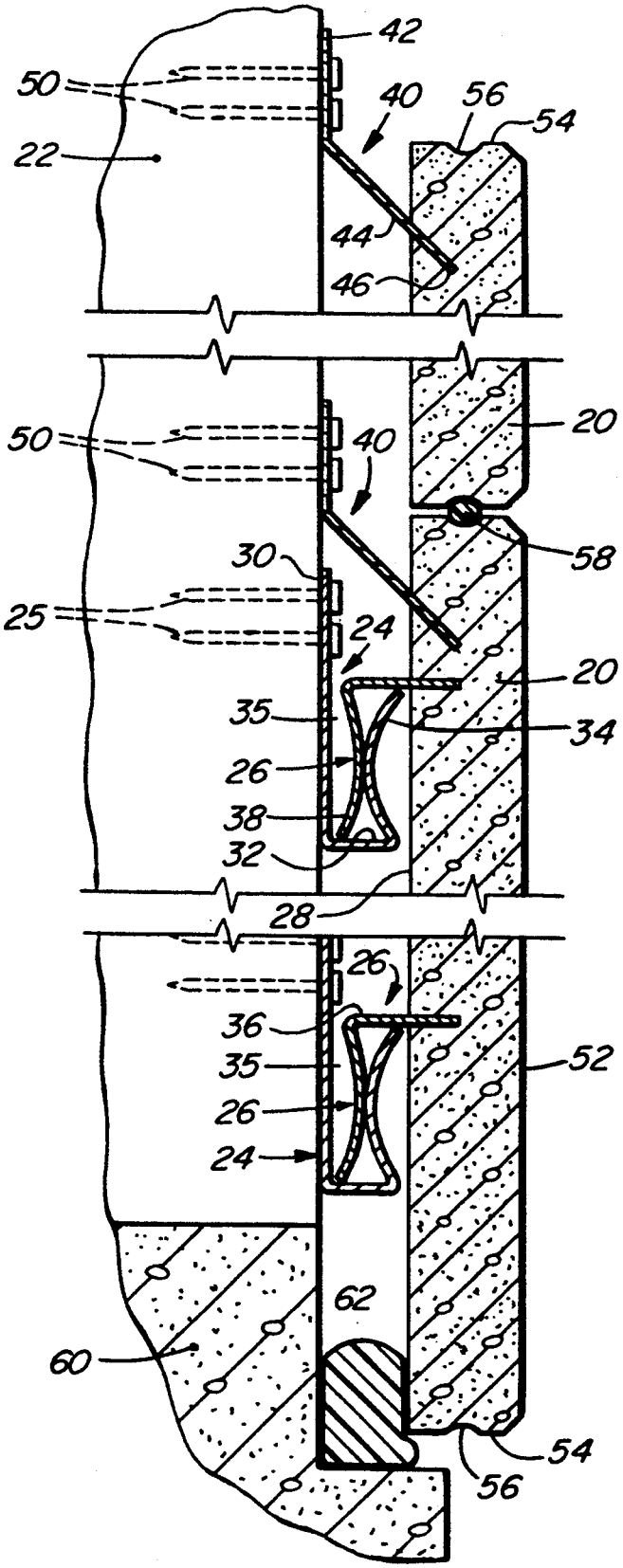
FIG. 2 shows a broken-away view, in vertical cross-section through parts of the building cladding system of FIG. 1 and parts of an adjacent wall.

Referring now to FIG. 2 of the accompanying drawings, there is shown an adjacent pair of pre-cast concrete cladding panels 20 secured to a wood stud 22 forming part of the front wall of the building 10. The cladding panels may alternatively be similarly secured to metal studs (not shown) instead of the wood studs 22. For each horizontal row of the cladding panels 20, a support rail 24 is secured to the building wall by fasteners in the form of nails 25.

The panels 20 are each provided with at least four support members indicated generally by reference numerals 26, which are spaced apart horizontally from one another and which project rearwardly from a rear face 28 of the respective cladding panel 20. Two of the support members 26 of each panel 20 are provided at a distance equal to one third of the height of the panel from the top of the panel and the other two are similarly spaced from the bottom of the panel.

The support rails 24 and the support members 26 are formed of metal channel sections.

The support rails 24 each have a flat, vertically extending rear wall 30, a flat bottom portion 32 extending forwardly from the bottom of the rear wall 30, and a forwardly concavely curved portion 34 extending upwardly from the front edge of the horizontal portion 32, at a spacing from the rear wall portion 30.

The rear wall portion 30, the horizontal portion 32 and the curved portion 34 form an upwardly-open recess 35 which, at the upper portion thereof, is upwardly divergent.

The support members 26 are each formed of a flat, horizontally extending portion 36, which is embedded in the rear face 28 of the respective cladding panel 20, and a curved portion 38 depending from the rear edge of the portion 36 at a spacing from the cladding panel rear face 28. The curved portion 38 is curved so that it diverges from the rear face 38, at the bottom of the curved portion 38.

Consequently, the curved portion 30 of the support rail 24 and the curved portion 38 of the support member 26 are readily engageable with one another by downward movement of the cladding panel relative to the building wall so as to insert the curved portion 38 into the recess 34.

The curved portions 34 and 38 are formed with opposed convex curvatures. The support rails 24 and the support members 26 have been shown with small gaps between them to facilitate the illustration of these parts. However, it is understood that, in fact, they interengage with one another so as to hold the cladding panels 20 tightly in position relative to the building wall, and the concave curvatures of the support rails 24 and the support members 26 facilitate such tight interengagement.

Each cladding panel 20 is also provided with at least two metal projections, indicated generally by reference numerals 40, projecting from the rear faces 28 of the cladding panels 20.

Each metal projection 40 is formed of a section of strip metal which is longitudinally bent to provide a vertical outer portion 42 and a forwardly and downwardly inclined lower portion 44, which has an edge portion 46 embedded in the rear face 28 of the cladding panel 20.

Fasteners in the form of nails 50 are provided for securing the metal projections 40 to the studs 22 of the building wall.

The cladding panels 20 each have a front face 52, which may comprise a surface shaped, for example, with grooves a rock facing, a brick veneer or a horizontal or vertical siding pattern (not shown) to provide an attractive appearance, and a peripheral edge 54 in which a peripheral recess 56 is provided, so that adjacent panels 20 can be sealed relative to one another by the provision of a resilient seal 58 in the grooves 56 of the adjacent cladding panels 20. The metal projections 40 extend past the peripheral edges 54 and, none particularly, the outer portions 42 are located beyond the peripheral edges 54 of the respective panels 20.

As can be seen in FIG. 2, the studs 22 are provided on a concrete footing 60, and the longest cladding panels 20 are sealed, relative to the footing 60, by means of an elongate sealing member 62, which is sandwiched between the cladding panel 20 and the footing 60.

Figure 3:
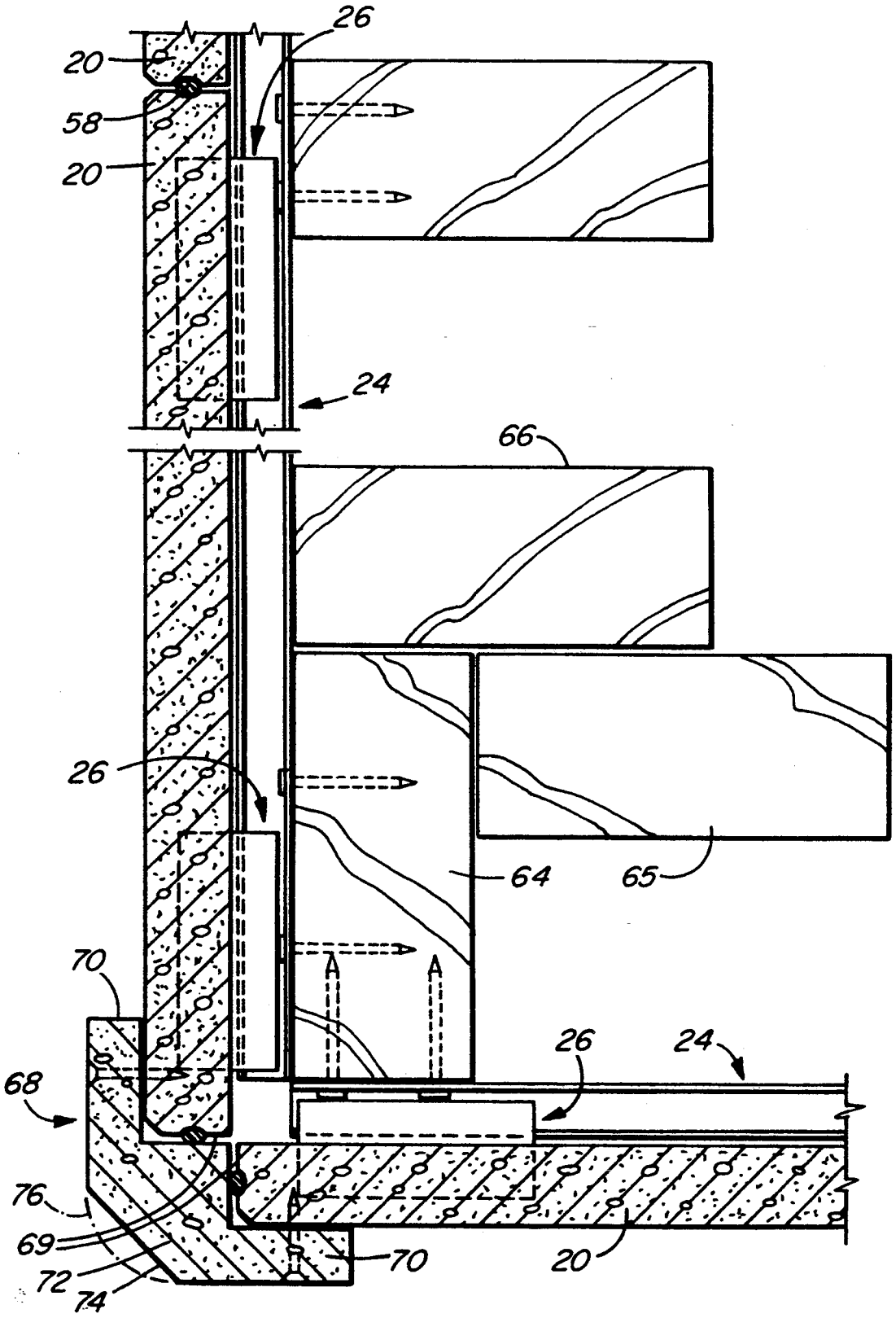
FIG. 3 shows a plan view, in horizontal cross-section through the cladding at a corner of the building of FIG. 1.

FIG. 3 shows an arrangement of three studs 64, 65 and 66 at a corner of the building, with a pair of support rails 24 extending from the corner at right angles to one another and supporting respective cladding panels 20. A vertically elongate corner piece indicated generally by reference numeral 68 is provided at adjacent vertical edges 69 of the panels 20, and is formed of a pair of mutually angularly disposed longitudinal edge portions 70, which are disposed in overlapping relationship with the adjacent vertical edges 69 and a vertical intermediate portion 72, which connects the edge portions 70 and is shaped to interfit between the adjacent vertical edges 69. The intermediate portion 72 is formed with a outer bevel surface 74, as shown in full lines in FIG. 3, but may alternatively be formed, for example, with a rounded outer surface as shown in broken lines and indicated by reference numeral 76.

The edge portions 70 of the corner piece 68 are secured to the adjacent cladding panels 20 by means of fasteners in the form of nails 78, which are inserted through the edge portions 70 and which penetrate into the front faces of the adjacent cladding panels 20.

Figure 4:
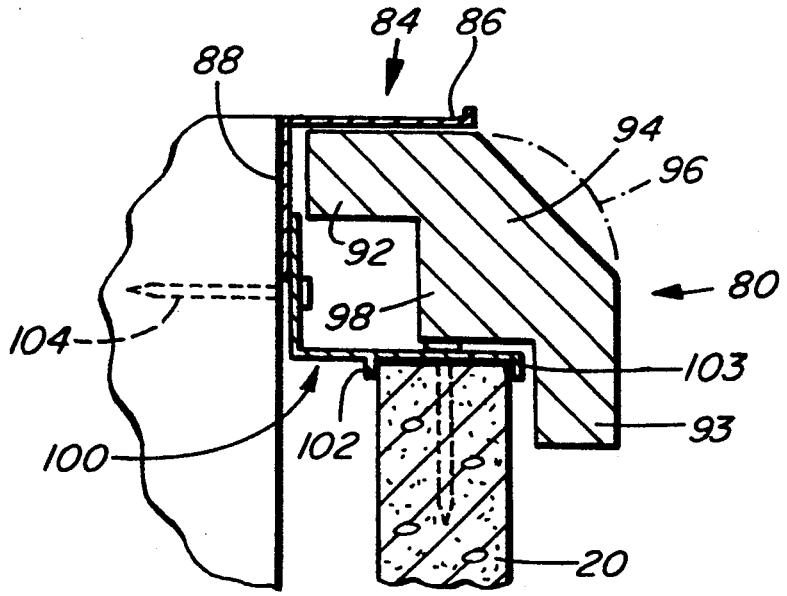
FIG. 4 shows a broken-away view in vertical cross-section through a window sill and adjacent portions of a building wall and a cladding panel.

FIG. 4 shows a capping member in the form of a window sill, indicated generally by reference numeral 80, provided at the top edge of one of the cladding panels 20.

As can be seen from FIG. 4, a window frame indicated generally by reference numeral 84 and having a flat, horizontal portion 86 overlying a part of the window sill 80 and a flat, vertical portion 88, extending downwardly from the horizontal portion 86, is provided at the bottom of a window opening.

The window sill 80 has mutually angularly disposed longitudinal edge portions 92 and 93, with the edge portion 92 extending along the underside of the portion 86 of the window frame 84, and with the edge portion 93 extending vertically downwardly so as to vertically overlap a top portion of a cladding panel 20. The edge portions 92 and 93 are connected by a bevelled intermediate portion 94. Instead of being bevelled, as shown in full lines in FIG. 4, the intermediate portion 94 may be formed with a rounded outer surface 96, as shown in broken lines. The intermediate portion 94 includes in inwardly projecting shoulder 98 which partially overlies the cladding panel 20.

A further strip metal retainer member indicated generally by reference numeral 100 extends around the window frame 84 and retains the cladding panels 20 around the window opening. The retainer member 100 has a generally L-shaped configuration, with depending flanges 102 and 103 for engaging the rear and front faces, respectively, of the cladding panel 20. The retainer is secured by a fastener in the form of a nail 104 to the building wall.

Figure 5:
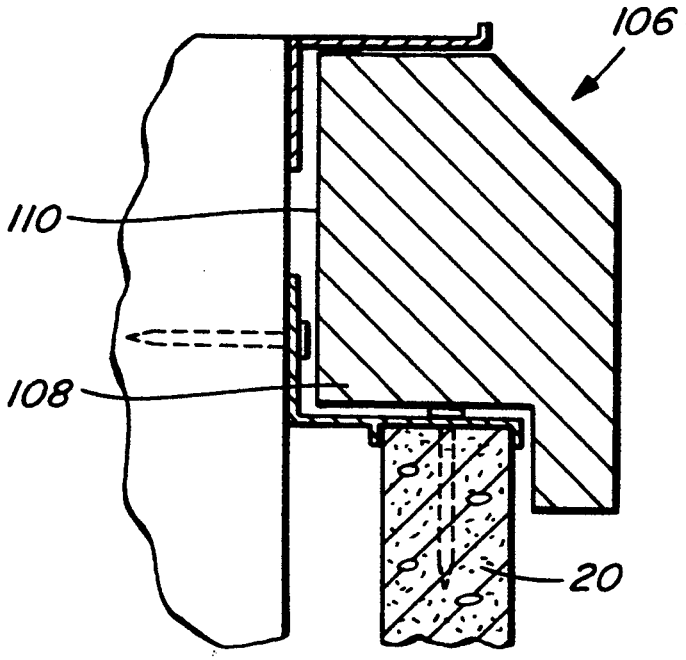
FIG. 5 shows a view corresponding to that of FIG. 4, but illustrating a modified form of window sill.

FIG. 5 shows a modification of the sill of FIG. 4. In the modified sill shown in FIG. 5 and indicated generally by reference numeral 106, the shoulder 98 of the sill 80 of FIG. 4 is replaced by a substantially larger shoulder 108, the bottom of which extends rearwardly as far as a rear face 110 of the sill 106.

The nails referred to above may be replaced b screws (not shown).

While FIGS. 4 and 5 show window sills, it is to be understood that a similar construction may be employed for other openings in walls or other capping of the cladding.

As will be apparent to those skilled in the art, various modifications may be made to the above-described embodiments of the invention within the scope of the appended claims.

I claim:

1. A building cladding system, comprising:

a plurality of cladding panels each having a front face, a rear face and a peripheral edge;

a plurality of metal support rails;

rail fasteners for securing said support rails horizontally on a wall of a building; said cladding panels having metal support members extending rearwardly from said rear faces of said cladding panels;

said support members and said support rails having portions which are interengageable for suspending said cladding panels from said support rails;

said cladding panels further comprising metal projections extending from said rear faces and including securement portions located beyond said peripheral edges of the respective ones of said cladding panels; and further fasteners engageable with said securement portions for securing said metal projections to the building wall.

2. A building cladding system as claimed in claim 1, wherein said portions of said support rails form upwardly open recesses and said portions of said support members extend downwardly and are spaced from said rear faces so as to be engageable in said upwardly open recesses.

3. A building cladding system as claimed in claim 2, wherein said interengageable portions of said support rails and said support members are formed of metal channel sections, said recesses of said support rails being upwardly divergent and said portions of said support members diverging downwardly from said rear faces to facilitate relative movement of said support rails and said support members into mutual interengagement.

4. A building cladding system as claimed in claim 3, wherein said interengageable portions of said support rails and said support members are formed with opposed convex curvatures.

5. A building cladding system as claimed in claim 1, further comprising corner pieces for securement over adjacent vertical edges of said cladding panels at corners of the building, said corner pieces comprising mutually angularly disposed longitudinal edge portions for overlapping relationship with the adjacent vertical edges of said cladding panels, and a vertical intermediate portion connecting said edge portions and shaped to interfit between said adjacent vertical edges of said cladding panels.

6. A building cladding system as claimed in claim 1, further comprising a capping member having depending horizontal edge portions for vertically overlapping edge portions of said cladding panels at an opening in a wall, and metal retainers for attachment to the edge portions of said window sills.

* * * * *